US007708271B2

(12) United States Patent
Major, Jr.

(10) Patent No.: US 7,708,271 B2
(45) Date of Patent: May 4, 2010

(54) NON-CONTACTING STATIC BRUSH FOR A SHEET STACKER

(75) Inventor: Wilbert Lee Major, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 434 days.

(21) Appl. No.: 11/498,701

(22) Filed: Aug. 3, 2006

(65) Prior Publication Data

US 2008/0029952 A1 Feb. 7, 2008

(51) Int. Cl.
*B65H 31/00* (2006.01)

(52) U.S. Cl. ..... 271/208

(58) Field of Classification Search ..... 271/315, 271/187, 208

See application file for complete search history.

(56) References Cited

U.S. PATENT DOCUMENTS 1,573,414 A * 2/1926 Mahoney ..... 271/208
2,883,190 A 4/1959 Manthey
3,957,264 A * 5/1976 Bach et al. ..... 271/287
4,307,432 A * 12/1981 Nishikawa ..... 361/221
4,385,824 A * 5/1983 Hollo ..... 399/90
4,834,361 A * 5/1989 Fenske et al. ..... 271/187
4,951,935 A * 8/1990 Oikawa ..... 271/208
5,123,893 A 6/1992 Grooms
5,354,607 A * 10/1994 Swift et al. ..... 310/251
5,478,061 A * 12/1995 Murakami et al. ..... 270/58.08
5,732,943 A * 3/1998 Delfosse ..... 271/228
6,048,119 A * 4/2000 Kato et al. ..... 400/624
6,152,445 A * 11/2000 Hirota et al. ..... 271/315
6,575,461 B1 * 6/2003 Rider ..... 271/315

FOREIGN PATENT DOCUMENTS

JP 3-264458 * 11/1991
JP 9-124206 * 5/1997

OTHER PUBLICATIONS

English translation of relevant portions of numbered paragraph [0014] of Japanese Publication No. 9-124206.*

* cited by examiner

*Primary Examiner*—Patrick H Mackey
*Assistant Examiner*—Thomas A Morrison
(74) *Attorney, Agent, or Firm*—Prass LLP

(57) ABSTRACT

An apparatus for accumulating sheets in a stack, such as would be used in a printer or copier, comprises a tray for retaining sheets. A conductive member, which may include brush filaments, is disposed less than 10 mm from a location of an edge of the sheets, and does not contact any sheets on the tray.

8 Claims, 4 Drawing Sheets

NON-CONTACTING STATIC BRUSH FOR A SHEET STACKER

TECHNICAL FIELD

The present disclosure relates to a stacker for accumulating sheets, such as in a printing apparatus or a copier.

BACKGROUND

In a digital printer or copier, or in any situation in which sheets are transported through an apparatus and accumulated in a stack, the effects of static electricity must be taken into account. The charging events associated with xerography, or even just the sliding contact of sheets against structures within a machine, cause individual sheets to have static charges. When such charged sheets are accumulated in a stack, such as for stapling, the mutual repulsion of like-charged sheets causes the edges of upper sheets on the stack to rise a significant distance from each other, so that the top sheet at any time is not remotely flat. The raised edges, of course, interfere with subsequent activities such as stapling or collating.

A generally-known approach to this problem is to discharge each sheet as the sheet approaches the stack. The discharging is typically done by having the sheet contact a substantially grounded brush or other member as it moves toward the stack, thereby discharging the sheet. U.S. Pat. Nos. 2,883,190 and 5,123,893 show typical ways of applying a discharging brush to a moving sheet.

The use of a "static brush" contacting individual sheets directed toward a stack has some disadvantages, such as possible image area contamination, and does not necessarily fully address discharge of the accumulated additive charge of a thick stack of sheets having small retained charges, especially in dry ambient conditions.

SUMMARY

According to one aspect, there is provided an apparatus for accumulating sheets in a stack, comprising a tray for retaining sheets. A conductive member is disposed less than 10 mm from a location of an edge of the sheets, and does not contact any sheets on the tray.

According to another aspect, there is provided an apparatus for accumulating sheets in a stack, comprising a tray for retaining sheets, and a conductive member having brush filaments disposed less than 10 mm from a location of an edge of the sheets, disposed not to contact any sheets on the tray.

DETAILED DESCRIPTION

Figure 1:
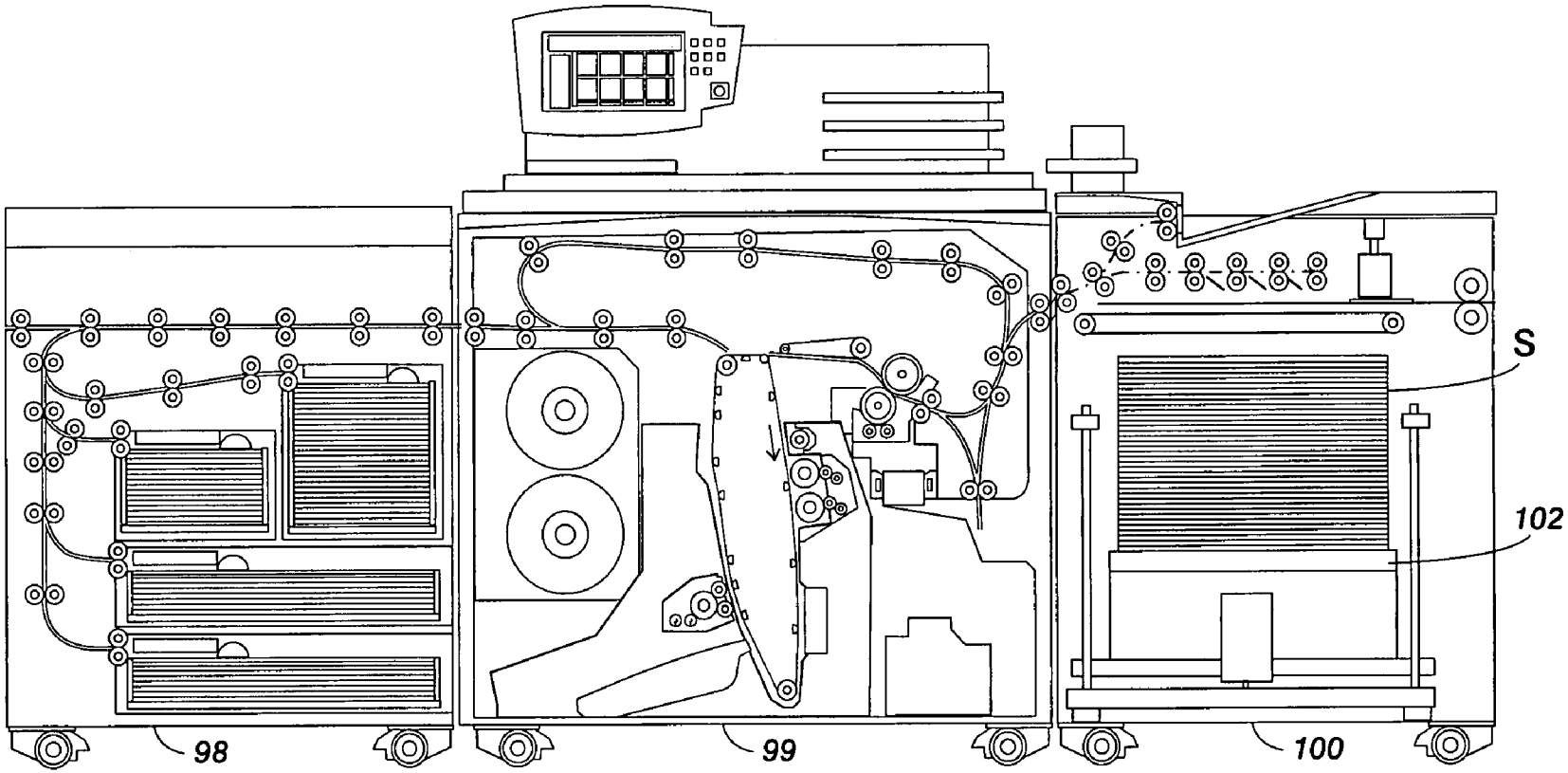
FIG. 1 PRIOR ART
FIG. 1 is an overall view of a high-speed digital printer copier, as generally known in the art.

FIG. 1 is an overall view of a high-speed digital printer copier, as generally known in the art. The machine includes one sheet input module 98, that feeds blank sheets into a printing module 99, which includes, as generally shown, a xerographic engine. Printed sheets output from printing module 99 are directed to a stacker module 100. In this embodiment, stacker module 100 includes a tray 102, mounted on an elevator mechanism (not shown), of general familiarity in the art, which operates to lower the tray 102 as sheets are accumulated thereon, so that the top sheet in the stack S is always at the same general elevation regardless of the size of the stack S.

Figure 2:
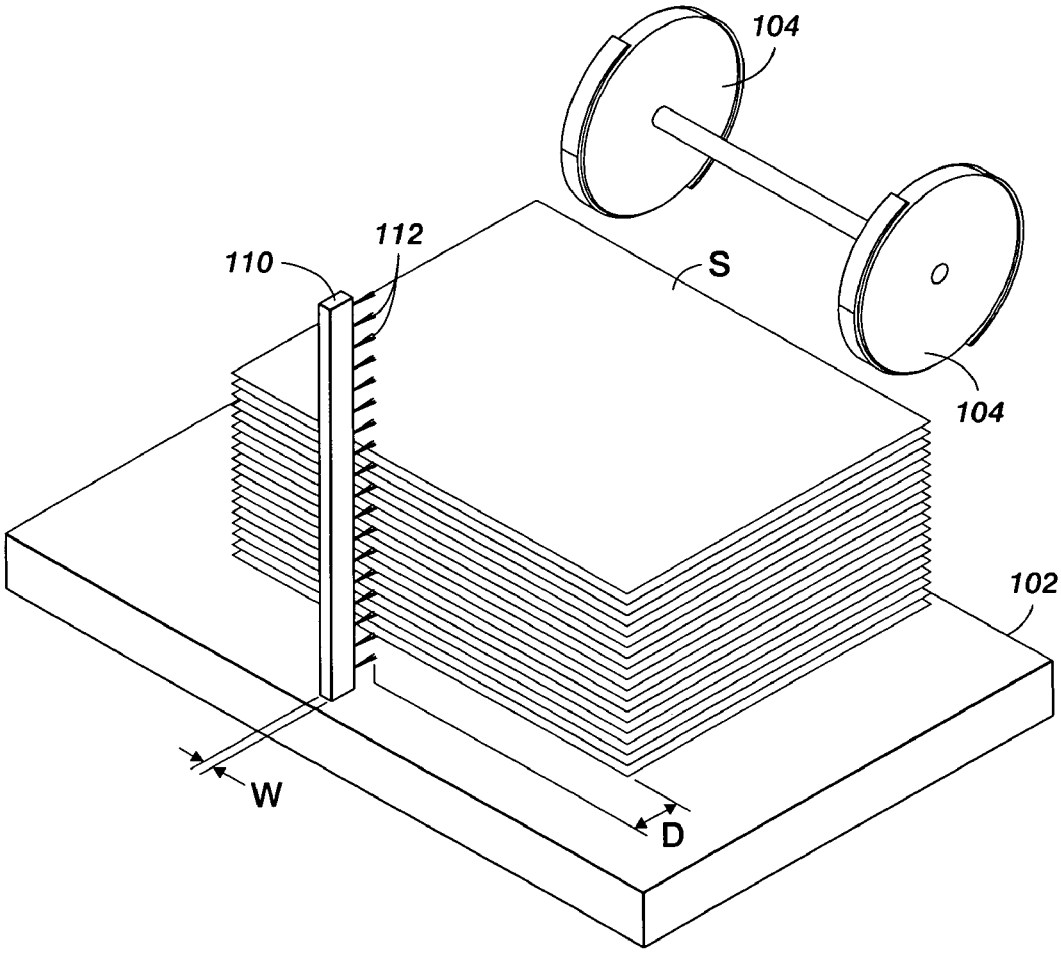
FIG. 2 is a perspective view showing the configuration of parts in a stacker module.

FIG. 2 is a perspective view showing the configuration of parts in a stacker module. Sheets are added to the stack S by a pair of disk stackers 104, of general familiarity in the art: sheets fed from the printing module 99 are first accumulated in a set in one of the slots along the circumference of each disk stacker 104; and when the sheets forming the set are completed, the disks rotate together to cause the whole set to be deposited on the stack S, which in turn is supported by tray 102. Typically, as each set is deposited on the stack S, the elevator mechanism lowers the tray 102 a small amount to maintain the top sheet in stack S at a constant level.

In order to discharge static electricity from sheets in stack S, there is provided a conductive member 110 disposed in a predetermined location relative to an edge of the sheets in stack S. The conductive member 110 must have some conductive properties, and is effectively grounded, at least to the frame of the machine itself. In one embodiment, conductive member 110 includes tufts 112 of conductive filaments forming a brush directed toward the stack S: the conductive member 110 can comprise the same type of commercially-available "static brush" used in systems that contact sheets moving therepast. In the present embodiment, however, the conductive member 110 does not have to contact any sheet in stack S at any time to satisfactorily discharge sheets in the stack. A surface (such as a brush) of the conductive member 110 is disposed a distance D from any edge of the stack S, the distance being less than 10 mm.

Further as shown in the embodiment, a width (along dimension W) of the conductive member is less than 25 mm, and in the case where a piece of commercially-available static brush is used, is approximately 2 mm. The height of the conductive brush 110 is typically at least 25 mm, but should just be long enough to discharge a sufficient proportion of the stack S within typical heights of stack S. The conductive member can have a height greater than 25 mm. Also, the conductive member can have a width less than 10 mm. Although conductive member 110 is shown near the center of one edge of stack S, the conductive member 110 can be located near any corner of stack S.

Figure 3:
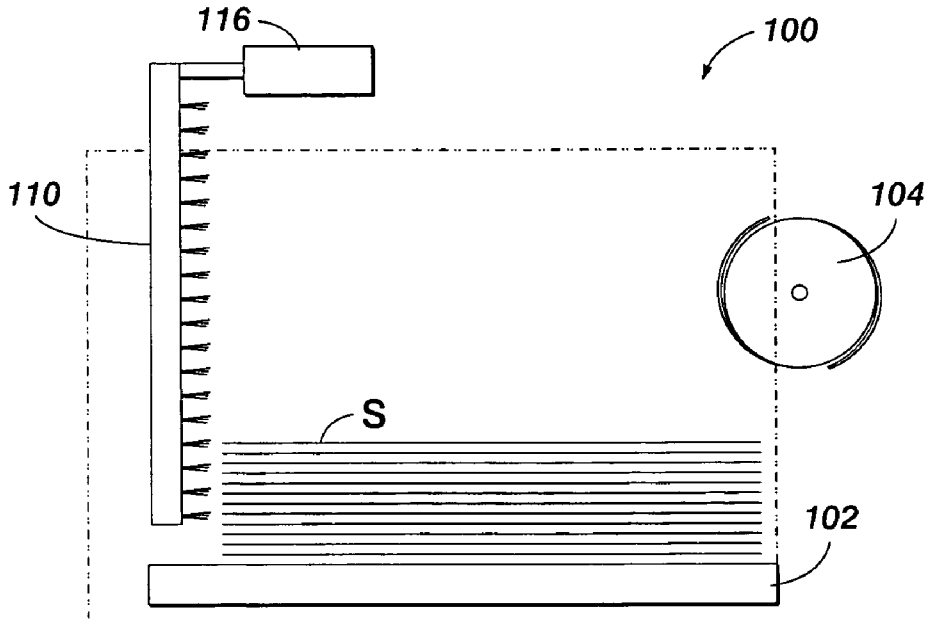
FIGS. 3-6 are simple elevational views of a portion of a stacker, showing various embodiments.

FIGS. 3-6 are simple elevational views of a portion of a stacker, showing various embodiments. In each Figure, like numbers indicate equivalent elements. FIGS. 3-6 (and FIG. 2) show conductive members 110 spaced from disk stackers 104. In FIG. 3, the conductive member 110 descends from an upper portion of the stacker module, suitably positioned to discharge sheets toward the top of tray 102, regardless of the position of tray 102 at any time.

Also shown in FIG. 3 is an adjusting mechanism 116 for adjusting a position of the conductive member 110 relative to an expected location of an edge of the sheets. That is, if it is known that the sheets to be accumulated on tray 102 are of a particular size, the position of conductive member 110 can be adjusted to bring the conductive member within a useful range of the accumulating stack S. The adjustment mechanism 116 can be manually operated, or can be moved via a device such as an electromagnet. The adjustment mechanism 116 can be associated with a larger control system; for example, in a digital printer/copier context, if it is known that blank sheets of a certain size are being fed from feeder module 98 or other upstream module, a control system can send a signal to cause adjustment mechanism 116 to position conductive member 110 suitably when the printed sheets are received in stacker module 100. The adjustment mechanism 116 can also be used in conjunction with a conductive member 110 that extends upwardly from tray 102, as in the FIG. 2 embodiment.

Figure 4:
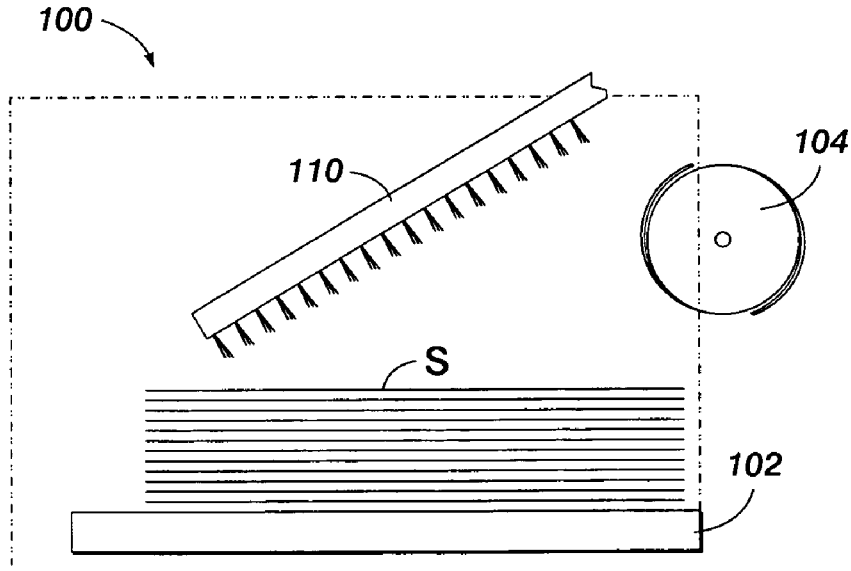

FIG. 4 shows an embodiment wherein the conductive member 110 is oriented diagonally or obliquely. Such an arrangement may be useful for discharging sheets, regardless of size, as each sheet enters the stacker module. The conductive member 110 may be specially shaped to have obliquely-oriented portions, including portions curved in one or more dimensions.

Figure 5:
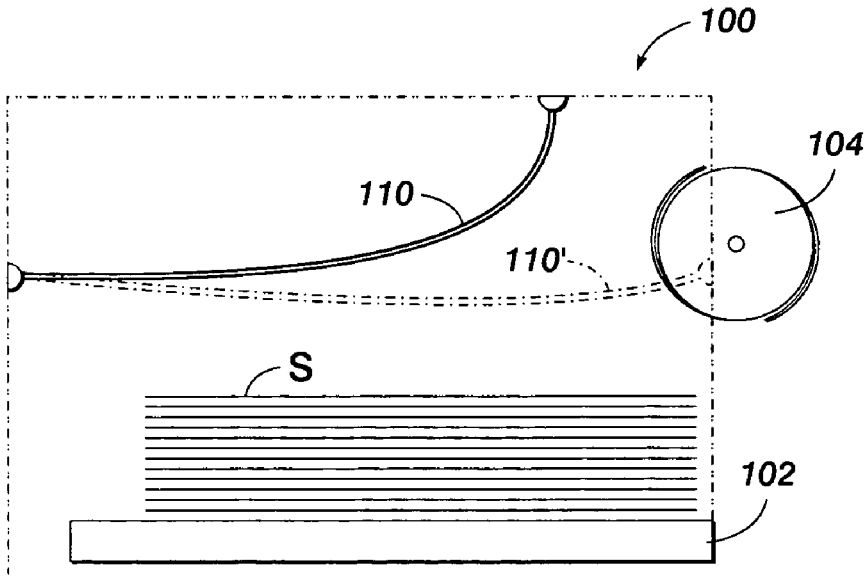
Figure 6:
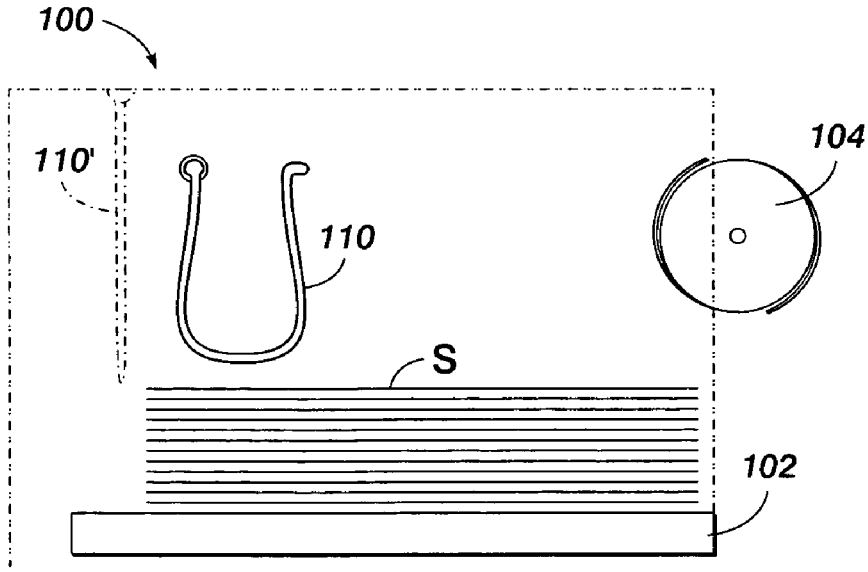

FIGS. 5 and 6 demonstrate various embodiments wherein the conductive member 110 or 110' largely comprises a flexible cord. A flexible cord can be disposed in any manner providing an effective discharge of the sheets approaching or in stack S. In FIG. 5 the conductive member 110 or 110' is attached to two fixed positions relative to the stacker module. In FIG. 6 the flexible cord 110 is attached to two fixed positions "inboard" and "outboard" relative to the stacker module, and flexible cord 110' simply hangs from one location within the cavity formed by the stacker module.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An apparatus for accumulating sheets in a stack, comprising:

a tray for retaining a stack of sheets;

a feed device for placing sheets on the tray;

a conductive member spaced from the feed device and located relative to the tray such that the conductive member discharges static electricity from sheets in the stack, the conductive member including brush filaments disposed less than 10 mm from a location of an edge of the stack of sheets, substantially directed toward the stack of sheets on the tray, and disposed not to contact any sheets in the stack on the tray; and an adjusting mechanism for adjusting a position of the conductive member relative to an expected location of the edge of the sheets, the adjusting mechanism effectively receiving a signal from an upstream module to cause adjusting a position of the conductive member based on the size of the sheets.

2. The apparatus of claim 1, the conductive member being supported on and extending upward from a surface of the tray on which the stack of sheets is supported.

3. The apparatus of claim 1, the conductive member extending downward from above the tray toward a surface of the tray on which the stack of sheets is supported.

4. The apparatus of claim 1, the conductive member being disposed above a surface of the tray on which the stack of sheets is supported, the conductive member being oriented obliquely relative to the surface such that the conductive member discharges sheets entering the apparatus.

5. The apparatus of claim 1, the brush filaments being directed substantially toward a surface of the tray on which the stack of sheets is supported.

6. The apparatus of claim 1, the feed device including a disk stacker.

7. The apparatus of claim 1, wherein the conductive member has a height greater than 25 mm and a width less than 10 mm.

8. The apparatus of claim 1, the brush filaments being directed substantially parallel to a surface of the tray on which the stack of sheets is supported.

* * * * *